US005716227A

United States Patent [19]

Detter

[11] Patent Number: 5,716,227

[45] Date of Patent: Feb. 10, 1998

[54] PUSH-RELEASE LOCK CONNECTOR

[75] Inventor: Gary Charles Detter, Canfield, Ohio

[73] Assignee: General Motors Corporation, Detroit, Mich.

[21] Appl. No.: 674,952

[22] Filed: Jul. 3, 1996

[51] Int. Cl.[6] ..... H01R 13/627

[52] U.S. Cl. ..... 439/353; 439/358

[58] Field of Search ..... 439/350, 353, 439/357, 358

[56] References Cited

U.S. PATENT DOCUMENTS

| | | | |
|---|---|---|---|
| 4,634,204 | 1/1987 | Detter et al. . | |
| 4,979,910 | 12/1990 | Revil et al. | 439/358 X |
| 5,026,298 | 6/1991 | Brussalis et al. | 439/358 |
| 5,562,468 | 10/1996 | Sakai et al. | 439/189 |

*Primary Examiner*—Khiem Nguyen

*Attorney, Agent, or Firm*—Cary W. Brooks

[57] ABSTRACT

The invention includes an electrical connector system including a first connector component having a body portion and at least a portion of a first electrical terminal carried therein. A shoulder extends outwardly from each side of the body portion. A flexible arm has one end attached to the shoulder and extends downwardly so that a gap exists between the arm and a side of the body portion. The flexible arm includes a lock pawl on the arm's inside edge closest to the body portion. A guide rib extends outwardly from the lock pawl in a direction away from the body portion. A second electrical connector component is provided and includes a body portion carrying at least a portion of a second electrical terminal designed to be matable with the first electrical terminal. A pair of spaced apart hooked fingers extend outwardly from each side of the second body portion to define an alignment slot between the tips of the hooked fingers and a channel between the hooked fingers and the side of the second body portion.

4 Claims, 2 Drawing Sheets

PUSH-RELEASE LOCK CONNECTOR

This invention relates to electrical connectors, and more particularly, to electrical connectors having releasable lock mechanisms.

BACKGROUND OF THE INVENTION

A variety of electrical connector systems are known. These systems have a variety of releasable lock components and alignment mechanisms. The present invention provides alternatives and advantages over the prior art.

SUMMARY OF THE INVENTION

The invention includes an electrical connector system including a first connector component having a body portion and at least a portion of a first electrical terminal carried therein. A shoulder extends outwardly from each side of the body portion. A flexible arm has one end attached to the shoulder and extends downwardly so that a gap exists between the arm and a side of the body portion. The flexible arm includes a lock pawl on the arm's inside edge closest to the body portion. A guide rib extends outwardly from the lock pawl in a direction away from the body portion. A second electrical connector component is provided and includes a housing carrying at least a portion of a second electrical terminal designed to be matable with the first electrical terminal. A pair of spaced apart hooked fingers extend outwardly from each side of the housing to define an alignment slot between the tips of the hooked fingers and a channel between the hooked fingers and the side of the housing. The hooked fingers are constructed and arranged so that the lock pawl can be received in the channel defined by the hooked fingers and the outwardly extending rib can be slid through the slot defined by the spaced apart finger tips. When the first electrical component is inserted into the second electrical component a lock shoulder of the lock pawl engages the hooked fingers to lock the components together. The components can be unlocked by pushing the guide rib inward towards the second body portion so that the lock shoulder disengages the hooked fingers and the components can be pulled apart.

These and other objects, features and advantages will become apparent from the following brief description of the drawings, detailed description and appended claims and drawings.

DETAIL DESCRIPTION

Figure 1:
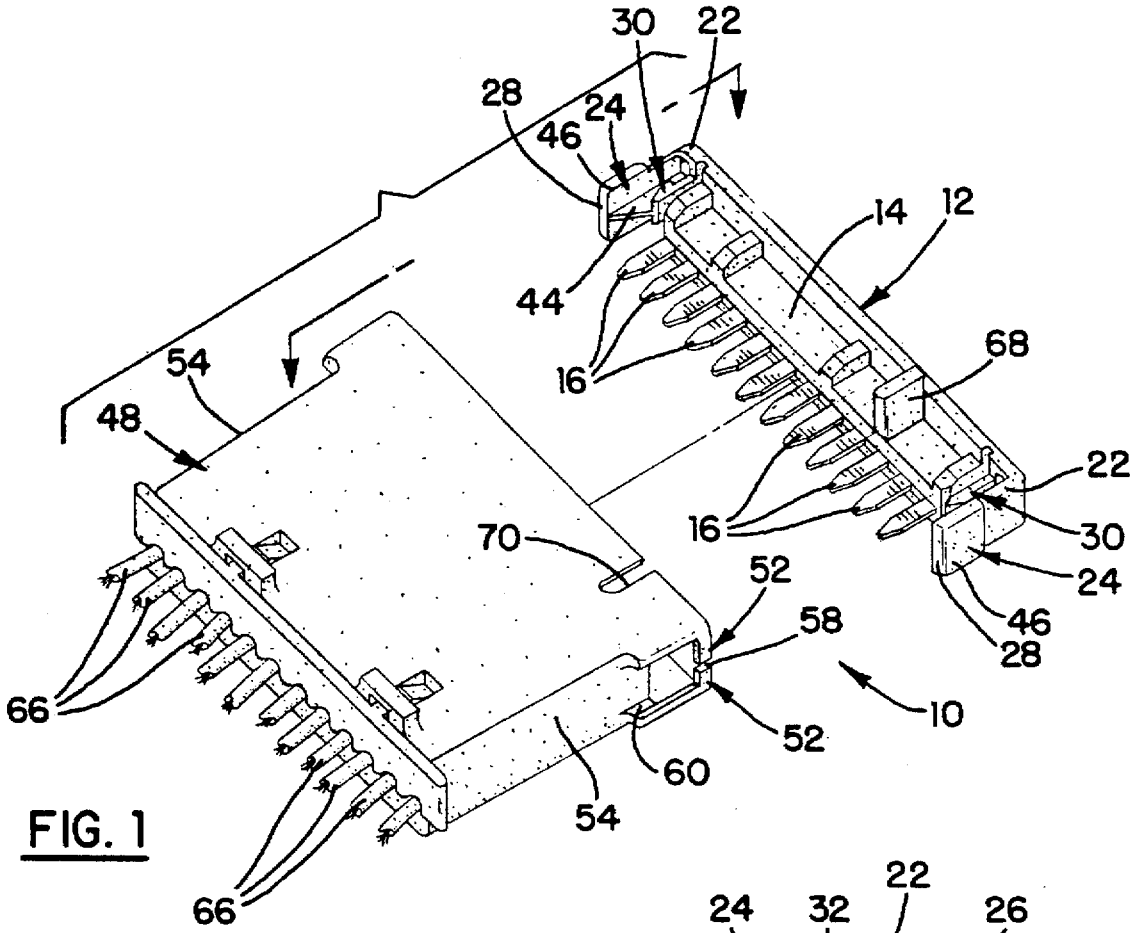
FIG. 1 is an exploded view of an electrical connector according to the present invention.
Figure 2:
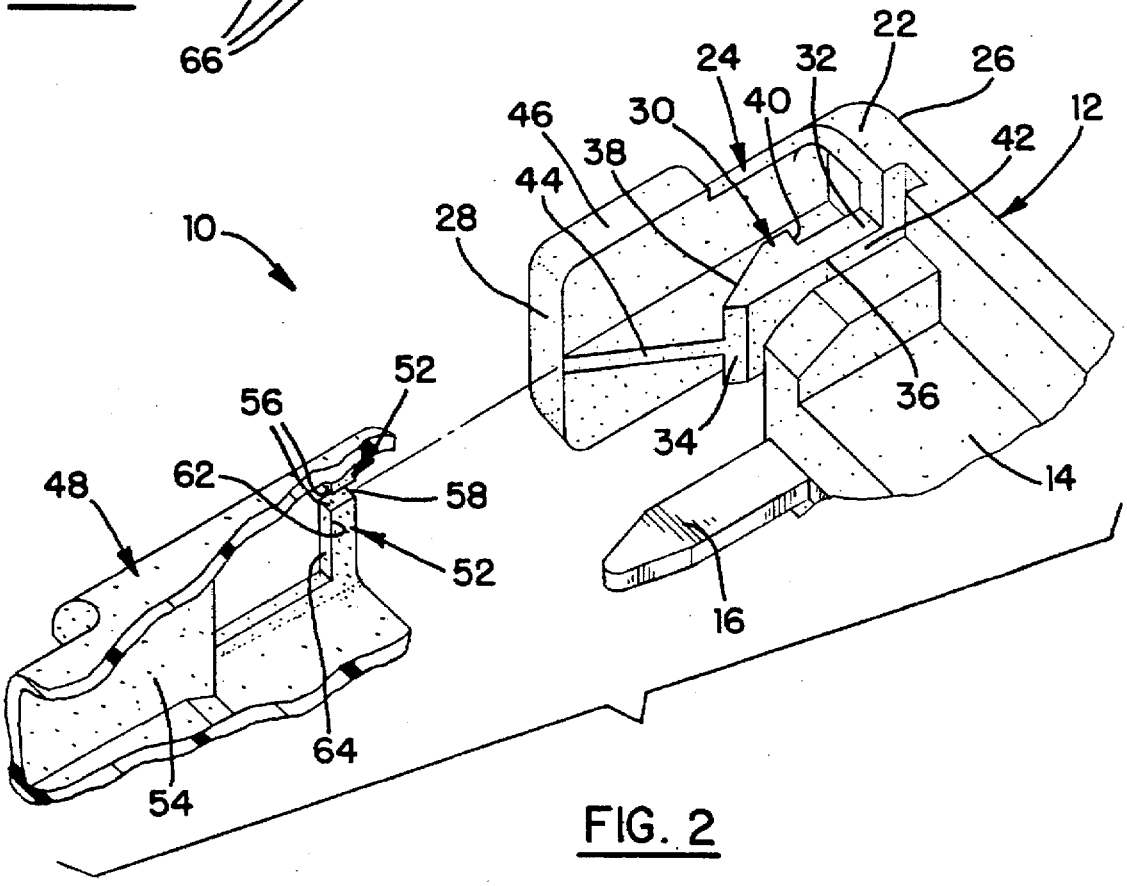
FIG. 2 is an enlarged, partial view of a male terminal connector with portions broken away according to the present invention.
Figure 3:
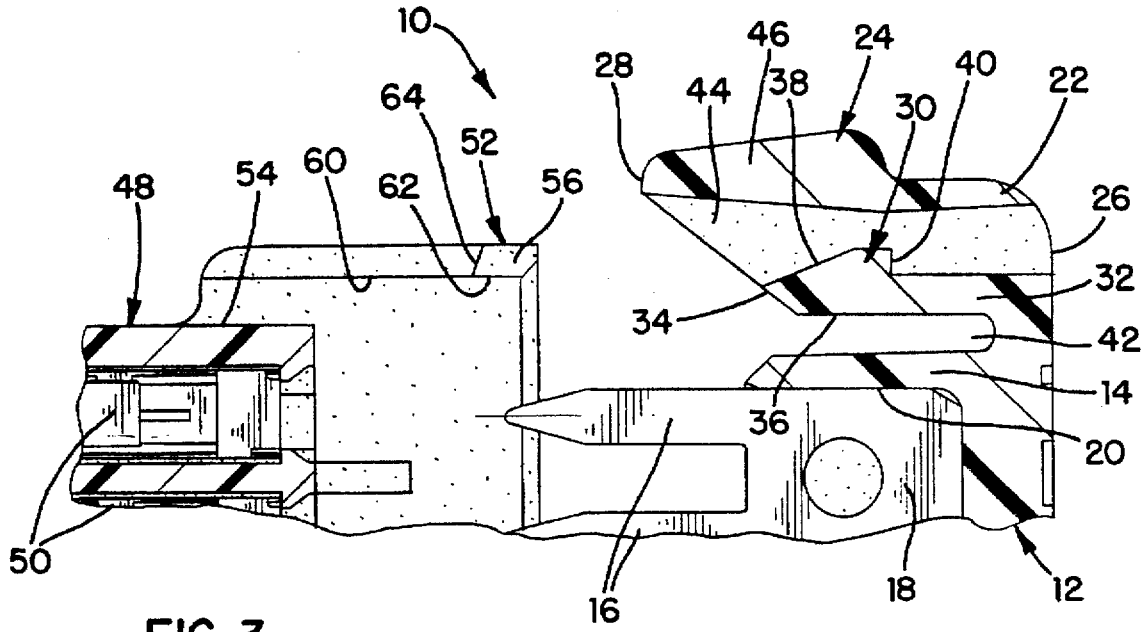
FIG. 3 is a top sectional view along 3—3 of FIG. 1 of a female terminal connector according to the present invention.
Figure 4:
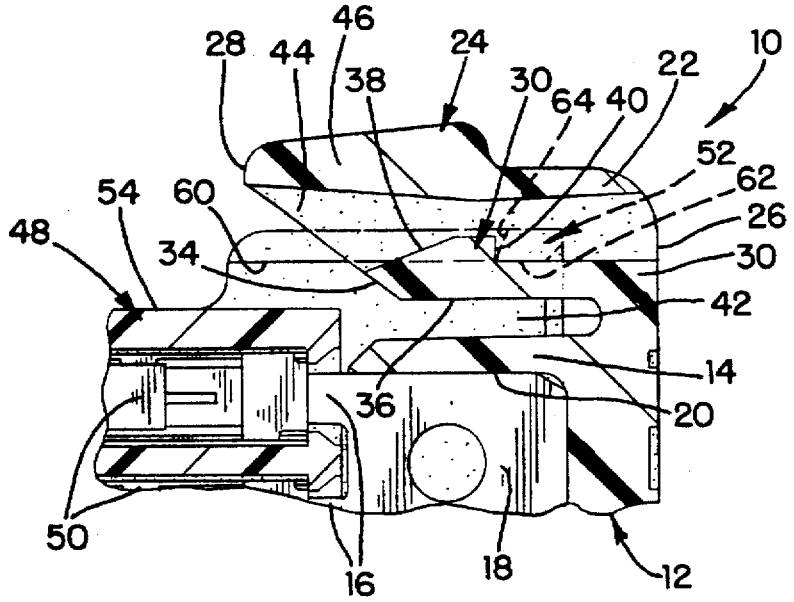
FIG. 4 is a view similar to FIG. 3 but with the components in a locked position.

FIG. 1 illustrates an electrical connector 10 according to the present invention and includes a male electrical terminal component 12 including a body portion 14 which carries at least a portion of a plurality of male blades 16. The male blades 16 are connected together by a base bar 18 (FIG. 3) and are frictionally received in a slot 20 formed in the body portion of the connector halve. A shoulder 22 extends outwardly from each side of the body portion 14. A flexible arm 24 has one end 26 connected to the shoulder and extends downwardly and terminates in a free-floating end 28. The arm includes a lock pawl 30 having a first end 32 connected to the shoulder and a second free end 34. The lock pawl has a flat surface 36 nearest the body portion 14 and a ramp surface 38 extends upwardly from the free end of the pawl towards the shoulder 22 and terminates near a lock shoulder 40 which extends in a perpendicular direction from the flat surface 36 of the pawl. The arm is constructed and arranged so that a gap 42 exists between the side of the body portion 14 and the flat surface 36 of the lock pawl. A guide rib 44 extends outwardly from the lock pawl in a direction which is away from the body portion of the terminal. Preferably the guide rib is centrally located on the lock pawl. An outer push plate 46 may be connected to the guide rib. The push plate 46 and the guide rib 44 extend downwardly a distance beyond the free end of a lock pawl so that greater leverage can be applied to the free end of the lock pawl causing the lock pawl to deflect a distance towards the side of the body portion 14.

A second electrical terminal component 48 is provided and preferably includes a plurality of female metal terminals 50 having at least a portion carried in a housing and constructed and arranged to mate with associated male blades on the first electrical terminal component. A pair of hooked fingers 52 extend outwardly from each side 54 of the housing preferably near the top edge. The hooked fingers include finger tips 56 which are spaced apart to define a slot 58 between the finger tips. The hooked fingers also define a channel 60 between the inside edge 62 of the fingers and the side 54 of the housing. Both electrical terminal components are constructed and arranged so that the lock pawl can be pushed downwardly into the channel 42 defined by the hooked fingers 52 so that the pawl ramp surface 38 engages the inside edge 62 of the hooked fingers 52 causing the pawl to be deflected towards the housing 14 until the lock shoulder 40 moves past the hooked fingers 52 causing the pawl to spring back and the lock shoulder 40 engaging the lower edge 64 of the hooked fingers 52. While the lock pawl is being pushed into the channel 42, the guide rib 44 is received in the slot 58 between the finger tips 52 to align the male electrical terminal component properly for insertion into the female electrical terminals. The components can be unlocked by pushing the push plate 46 towards the side of the housing causing the lock pawl to flex inwardly and thereafter pulling the male component upwardly when the lock shoulder is no longer engaging the lower edge of the hooked fingers.

Naturally a plurality of wires 66 may be connected to either male or female terminals to produce a variety of electrical connectors.

Optionally, the male electrical connector may have a second guide rib 68 extending downwardly from a top of the connector and in a direction that is perpendicular to the first guide rib 44. The second guide rib 68 may be received in a slot 70 formed in the housing of the second connector component so that the first and second guide ribs align the connector components in two directions.

As will be appreciated from the above description and the drawings, the present invention provides a locking system having opposing locking forces to that of the normal locking mode of the prior art, making it extremely difficult to unlock the connectors when pulled on as might happen during the transit or if a wire catches on the connectors. However, by pushing on both sides of the lock mechanisms the connectors are easily removed.

The present invention also provides a central rib/lock/slot feature that allows for prealignment of the connectors before and during mating of the assembly. With both the male and female receptacles in a locked together position the radial forces of the locks are in an outward direction from the main body of the receptacles, thus any attempt to pull the locks open to separate the male and female receptacles will only yield a tighter lock. This feature is of particular benefit when the receptacles are in transit with other items that may hook onto the lock area and thus try to separate the parts or during handling operations where an object may inadvertently catch on the lock component and unlock them.

What is claimed is:

1. An electrical connector assembly comprising:

a first connector component having a body portion carrying at least a portion of a metal electrical terminal therein;

a shoulder extending outwardly from the body portion and a flexible arm having a first end connected to the shoulder and extending downwardly terminating in a free end; said flexible arm including a lock pawl having a free end extending downwardly away from the shoulder; said lock pawl having a ramp surface extending upwardly from the free end and terminating near a lock shoulder; wherein said flexible arm and a side of the body portion define a gap therebetween;

a guide rib extending outwardly from the lock pawl in a direction away from the body portion;

a second connector component having a housing carrying a metal electrical terminal constructed and arranged for mating with an associated electrical terminal on said first connector component;

a pair of hooked fingers extending outwardly from a side of the housing and each finger terminating in finger tips which are spaced apart from each other to define a slot, said hooked fingers having an inside edge and wherein the hooked finger inside edge and the side of the body portion define a channel;

wherein said first and second electrical components are matable and lockable by inserting the lock pawl into the channel and the guiding rib into the slot so that the first connector is properly aligned with the second connector and so that the pawl ramp surface engages the inside edge of the hooked fingers causing the pawl to deflect inwardly towards the body portion until the lock shoulder engages a lower edge of the hooked fingers causing the two components to be mated and locked together; and wherein said first and second connector components can be unlocked and separated by pushing the lock pawl inwardly towards the body portion until the lock shoulder no longer engages the lower edge of the hooked finger and pulling up on the components to separate the first and second components.

2. An electrical terminal as set forth in claim 1 further comprising a push plate connected to the guide rib and extending in a perpendicular direction thereto.

3. An electrical connector as set forth in claim 2 wherein said guide rib and said push plate extend downwardly a distance from the free end of the lock pawl to provide greater leverage in pushing said lock pawl towards said body portion.

4. An electrical connector as set forth in claim 1 further comprising a second guide rib on one of said connector components and extending in a direction perpendicular to the first guide rib, a slot in the other connector component for receiving the second guide rib so that said first and second guide ribs align the connector components in two directions.

* * * * *